United States Patent [19]

Abys et al.

[11] Patent Number: 4,911,799

[45] Date of Patent: Mar. 27, 1990

[54] ELECTRODEPOSITION OF PALLADIUM FILMS

[75] Inventors: Joseph A. Abys, Warren; Vijay Chinchankar, Belleville; Virginia T. Eckert, Summit; Igor V. Kadija, Ridgewood; Edward J. Kudrak, Jr., Clifton; Joseph J. Maisano, Jr., Denville; Heinrich K. Straschil, Summit, all of N.J.

[73] Assignee: AT&T Bell Laboratories, Murray Hill, N.J.

[21] Appl. No.: 400,199

[22] Filed: Aug. 29, 1989

[51] Int. Cl.[4] ..... C25D 3/52; C25D 3/56

[52] U.S. Cl. ..... 204/44.6; 204/47

[58] Field of Search ..... 204/47, 44.6

[56] References Cited

U.S. PATENT DOCUMENTS

| | | | |
|---|---|---|---|
| 3,435,844 | 1/1975 | Skomoroski et al. | 204/44.6 |
| 3,972,787 | 8/1976 | Nobel et al. | 204/47 |
| 4,468,296 | 8/1984 | Abys et al. | 204/47 |
| 4,486,274 | 12/1984 | Abys et al. | 204/44 |
| 4,487,665 | 12/1984 | Miscioscio et al. | 204/47 |
| 4,491,507 | 1/1985 | Herklotz et al. | 204/47 |
| 4,493,754 | 1/1985 | Abys et al. | 204/47 |
| 4,545,869 | 10/1985 | Goldman | 204/47 |
| 4,552,628 | 11/1985 | Wilcox et al. | 204/47 |
| 4,622,110 | 11/1986 | Martin et al. | 204/47 |
| 4,628,165 | 12/1986 | Noble et al. | 200/268 |
| 4,778,574 | 10/1988 | Mathe et al. | 204/47 |

*Primary Examiner*—G. L. Kaplan

*Attorney, Agent, or Firm*—Walter G. Nilsen

[57] ABSTRACT

A process for electroplating palladium containing deposits from baths comprising a combination of a surfactant and a brightener combination. The surfactant is an alkyl, ammonium-type salt containing 4 to 35 carbon atoms. The brightener is 0-benzaldehydesulfonic acid, 1-naphthalene sulfonic acid, 2-naphthalenesulfonic acid, benzenesulfinic acid, oxy-4,4-bis (benzene) sulfinic acid, p-toluene sulfinic acid, 3-trifluoromethyl benzene sulfinic acid, allyl phenyl sulfone, 0-benzoic sulfamide, benzylsulfonyl propionamide, phenylsulfonyl acetamide, 3-(phenylsulfonyl) propionamide, benzene sulfonamide, bis (phenylsulfonyl) methane, guanidine carbonate, sulfaguanidine or nicotinic acid. This combination provides deposits having superior adhesion and ductility.

17 Claims, No Drawings

ELECTRODEPOSITION OF PALLADIUM FILMS

TECHNICAL FIELD

The invention relates to electroplating metal and alloys comprising palladium and articles comprising such electroplated palladium and palladium alloys.

BACKGROUND OF THE INVENTION

Palladium metal and alloys containing palladium are used extensively as protective coatings on a variety of articles and devices both for aesthetic reasons and for utilitarian reasons. Often, decorative articles such as jewelry, watches, etc. are coated with palladium metal or palladium alloy coatings to produce a bright, shiny surface attractive to the user. Also, such coated surfaces remain bright and shiny over long periods of time because of the chemical inertness of palladium coatings.

An extremely important use for palladium metal and alloys is for electrical contact surfaces in electrical contact devices and electrical connectors. Palladium is ideally suited for such applications because of its high electrical conductivity and because of its chemical inertness. Early electrical contact devices and electrical connectors used palladium metal and palladium alloys in the form of wrought metal or alloys or clad inlays often as a replacement for gold electrical contacts. More recently, considerable emphasis has been put on fabrication of electrical contact devices by electrodeposition of palladium metal and palladium alloys since electrodeposition is generally more convenient and a less expensive process for producing electrical contact devices and electrical connectors.

The development of a satisfactory electrodeposition process for palladium metal and palladium alloy has not proved to be easy. Despite extensive experimentation in this technology, electrodeposited palladium generally was not adherent, tended to be porous, often developed cracks and generally was quite brittle. Such a product generally was not satisfactory for use as electrical contacts in electrical devices and often left much to be desired for decorative articles.

It was quickly discovered that much of the problem in palladium electroplating was due to the incorporation of hydrogen in the palladium. Hydrogen is often a byproduct of palladium electroplating because of the close proximity of the potential for electrolyzing water to the plating potential for electroplating palladium. Incorporation of hydrogen into the palladium degrades many of the desirable properties of palladium metal such as ductility, adhesion, etc. Indeed, many palladium electroplating processes appeared to work well in the laboratory where the plating potential could be precisely controlled and plating rates are relatively low. However, under commercial manufacturing conditions, these processes proved unreliable either because the plating potential was not precisely controlled or because increasing the plating rate to that required in a commercial electroplating process necessitated plating potentials that led to the evolution of hydrogen during the electroplating process.

A major advance in palladium electroplating technology occurred with the discovery that certain palladium complex ions exhibited electroplating potentials far removed from the hydrogen evolution potential. The complexing agents involve certain aliphatic polyamines with best results obtained with 1,3 diamino propane.

This work is described in U.S. Pat. No. 4,486,274 issued to J. A. Abys, et al on Dec. 4, 1984.

This discovery led to a major commercial effect in palladium electroplating. The process has been used extensively in the United States and throughout the world to electroplate palladium typically for electrical contact surfaces in various devices such as electrical connectors. It has generally been used in applications formerly requiring gold contact surfaces and has led to considerable cost savings because of the lower cost of palladium as compared to gold. Further development work has been done as described in such references as U.S. Pat. No. 4,468,296 issued to J. A. Abys et al on Aug. 28, 1984 (replenishment compound for a palladium electroplating process) and U.S. Pat. No. 4,493,754 issued to J. A. Abys et al on Jan. 15, 1985 (unique anode structure for use in palladium electroplating process). Often, the palladium layer of the contact surface is covered with a very this layer of gold to improve wear characteristics.

Because of the success of the palladium electroplating process involving aliphatic amines, further improvements both in the electroplating process and properties of the electroplated palladium have become desirable. In particular, cost reduction in the palladium electroplating process is desirable as is greater versatility in the choice of palladium electroplating species. Also, greater ductility and adhesion of the electroplated palladium is desirable particularly for relatively thick (greater than 2.5–5.0 $\mu$m) layers. Such thick layers of palladium metal and palladium alloys would be highly useful for devices where extended wear is required.

Great adhesion and ductility is also required in stripe on strip connector manufacturing operations. Here, the contact metal (e.g. palladium) is electroplated as a stripe on a wide strip of substrate (e.g. a copper alloy) and this substrate with the stripe of contact metal punched and formed into connector pins. The electroplated contact metal stripe is placed on the strip in such a position and location that after the contact pin is formed the contact metal is located at the exact point where electrical contact is made with the mating contact structure.

Stripe on strip manufacturing operations for electrical contacts have a number of advantages. First of all, high speed plating procedures can be used to produce the plated strip rapidly and cheaply. Reel-to-reel continuous strip plating processes can be used which often produces high throughput at relatively low cost. Also, the same plated strip can be used for many different connectors and connector pins.

Because of the stamping operation on the plated strip, the electroplated palladium or palladium alloy must be highly adherent to the substrate material and extremely ductile, and remain crack-free and porosity-free after the stamping operation.

A variety of references have disclosed palladium electroplating processes including U.S. Pat. No. 4,487,665 issued to K. B. Miscioscio et al on Dec. 11, 1984; U.S. Pat. No. 4,491,507 issued to G. Herklotz et al on Jan. 1, 1985 and U.S. Pat. No. 4,545,869 issued to I. Goldman on Oct. 5, 1985. The palladium tetra-ammine complex is used as the source of palladium in a number of palladium electroplating processes including those described in U.S. Pat. No. 4,622,110 issued to J. L. Martin et al on Nov. 11, 1986; U.S. Pat. No. 4,552,628 issued to J. Wilcox on Nov. 12, 1985 and U.S. Pat. No. 4,628,165 issued to F. I. Nobel on Dec. 9, 1986.

SUMMARY OF THE INVENTION

The invention is palladium and palladium alloy electroplating process in which the electroplating bath comprises in addition to a source of palladium certain organic additives that are generally regarded as surfactants and brighteners. The bath contains at least one surfactant and at least one brightener. The surfactants are typically selected from alkyl ammonium chlorides with 4 to 35 carbon atoms, preferably alkyltrimethylammonium chlorides from octyltrimethylammonium chloride to octadecytrimethylammonium chloride. Too few carbon atoms in the surfactant molecule reduces the surfactant quality of the compound (e.g. the compound in the solution does not form a strong surface film); too many carbon atoms in the surfactant compound structure makes the compound insufficiently soluble in the electroplating bath for many applications. Most preferred for the surfactant is dodecyltrimethylammonium chloride.

A large variety of brighteners may be used in the practice of the invention. Included in the list of brighteners are a variety of organic sulfur compounds such as sulfones and sulfonic acids and sulfur-nitrogen compounds such as various sulfamides. Plated films made in accordance with the invention exhibit excellent ductility, are crack-free even when made to considerable thickness (e.g. 2–10μm), have a bright finish and exhibit excellent electrical contact characteristics and wear characteristics.

DETAILED DESCRIPTION

The invention is a metal electroplating process in which the metal comprises palladium. The invention is based on the discovery that the incorporation of certain organic additives in the electroplating bath makes the quality of the electroplated metal (palladium or palladium alloy) unusually good even when electroplating rates are quite high and the thickness of the electroplated film is quite great. Both pure palladium and various palladium alloys are electroplated with excellent results. Typically, palladium alloys are made up of at least 10 mole percent palladium, remainder nickel, cobalt, arsenic and/or silver. Alloy compositions of at least 30, 50 or 70 mole percent palladium, remainder arsenic, nickel, cobalt and/or silver are typical and nickel is a preferred alloying metal.

The invention is concerned with the composition of the electroplating bath; in particular with the presence in the bath of certain organic additives often called surfactants and brighteners. The bath contains at least one surfactant and at least one brightener. Surfactants are aliphatic quaternary ammonium salts with from 4 to 35 carbon atoms. The anion of the quaternary ammonium salt may be selected from a variety of ions including halogens (e.g. chloride, bromide and iodide), other well known inorganic anions (e.g. sulfates, chlorates, etc.) and various organic anions such as the acetate ion. Most preferred is the chloride ion because of availability of quaternary ammonium chloride compounds, stability of the chloride ion, availability and excellent results obtained. Preferred are aliphatic straight-chain trimethylammonium chlorides with chain lengths between 8 and 18 carbon atoms. More preferred are the quaternary salts with chain lengths between 11 and 13 (e.g. undecyltrimethylammonium chloride, dodecyltrimethylammonium chloride and tridecyltrimethylammonium chloride) with dodecyltrimethylammonium chloride most preferred. Concentration of the surfactant may vary over large limits but typical concentration ranges from 0.0002 to 0.4 molar with the range from 0.004 to 0.02 molar preferred.

The electroplating bath also contains one or more brighteners. Typical brighteners useful in the practice of the invention are often sulfur-containing organic acids and their salts. Typical examples are o-benzaldehydesulfonic acid, 1-naphthalene sulfonic acid, 2-naphthalenesulfonic acid, benzenesulfinic acid, oxy-4,4-bis(benzene)sulfinic acid, p-toluenesulfinic acid, and 3-trifluoromethylbenzenesulfinic acid. Additional brightening agents useful in the practice of the invention are allyl phenyl sulfone, o-benzoic sulfamide, benzylsulfonyl propionamide, phenylsulfonyl acetamide, 3-(phenylsulfonyl)propionamide, benzene sulfonamide, bis(phenylsulfonyl)methane, guanidine carbonate, sulfaguanidine and nicotinic acid. Preferred are the following brightening agents: benzenesulfonic acid, 3-trifluoromethylbenzenesulfinic acid and allyl phenyl sulfone with allyl phenyl sulfone most preferred. Concentration of the brightener may vary over large limits; for example from 0.00005 molar to saturation with 0.002 to 0.05 molar preferred and 0.001 to 0.01 molar most preferred. Some brightener is usually used up during the plating operation.

Most preferred is the combination of dodecyltrimethylammonium chloride and allyl phenyl sulfone as surfactant and brightener respectfully with a concentration of 0.01 molar for the surfactant and 0.0005 molar for brightener.

In other regards, the composition of the electroplating bath is conventional. Palladium is contained in the aqueous bath in the form of a soluble species suitable for use in an electroplating process. Particularly useful are palladium complex ion compounds such as $Pd(NH_3)_2Cl_2$ and the corresponding bromide and iodide as well as other stable anions such as sulfates, nitrates, etc., the palladium tetra-ammine salts such as $Pd(NH_3)_4Cl_2$ and the corresponding bromide and iodide as well as other stable anions such as sulfates, etc., and various palladium complexes in which the complexing agent is an organic compound such as an amine (see for example U.S. Pat. No. 4,486,274 which is incorporated by reference). Also useful as a source of palladium are palladium complex hydroxides such as palladium hydroxide complexed with various organic compounds such as organic amines and polyamines and complexed with ammonia (e.g. di-μ-hydroxo-bis-[cis-diammine palladium (II)]).

Also useful as a source of palladium are various simple palladium compounds such as $PdCl_2$ and the corresponding bromide and iodide, $PdSO_4$, $Pd(NO_3)_2$, etc.

The concentration of palladium may vary over large limits. For example, concentrations as low as 0.00005 M are useful as are concentrations up to saturation of the source of palladium. Excellent results are obtained in the concentration range from 0.005 to 1.0M with the concentration range 0.28±0.05M yielding best results. Too low a concentration of palladium is often inconvenient because of frequent replenishments needed and the fact that even modest plating rates will consume all the palladium present in a very short time. Higher palladium concentrations are usually associated with higher electroplating rates. Very high concentrations of palladium are not detrimental to the quality of the plated films but often are avoided to prevent inconvenient precipitation of the palladium source. This is particularly true since other ion concentrations may vary considerably during the lifetime of the bath and affect the solubility of the source of palladium. Halide palladium salts, including palladium halide complex salts (particularly chlorides) are preferred as are sulfate palladium salts because of stability and high solubility. Also, ammonia is preferred as the complexing agent (palladium ammine salts) because of cost, availability, solubility and ease of removing the ammonia from the bath. Most preferred is palladium tetra-ammine chloride $Pd(NH_3)_4Cl_2$ because of cost, high solubility and stability.

For palladium alloy electroplating, some of the palladium is replaced by one or more of the alloying metals such as nickel, cobalt, silver and arsenic. Best results are obtained with nickel and arsenic. Any compound compatible with the electroplating bath and electroplating process may be used including various metal complex compounds and various metal salts. Sulfates and chlorides are usually preferred because of stability and high solubility. Typical examples for nickel alloys are $NiCl_2$ and $NiSO_4$; for arsenic alloys, $As_2O_3$ and $As_2O_5$.

Plating rates in terms of current densities may also vary over large limits, typically from 0.01 to often greater than 500 or even 1000 milliamperes per square centimeters. Typical rates are 50 to 200 milliamperes per square centimeters.

Temperature of the bath may vary from the freezing temperature of the bath to the boiling temperature of the bath with room temperature often preferred for convenience or slightly higher temperatures) 25–55 degrees C.) preferred under certain circumstances (e.g. high plating speed, high concentrations of salts in the bath). Typically, the bath is often operated at 40 degrees C.

The pH may vary over large limits (e.g. 6.0 to 13.5) but generally alkaline or slightly acidic values are preferred with 6.5 to 8.5 used most often. The range 7.0 to 8.0 is more preferred with the range around 7.5±0.2 most preferred. Very high pH values for the electroplating bath leads to excessive loss of ammonia; too low a pH might lead to precipitation of some of the components of the bath or undesirable chemical attack on the surface being electroplated.

Other ingredients may be present in the bath to improve electrical properties of the bath, stabilize the palladium source or stabilize acid concentration of the bath. For example, conducting salts may be added to the bath to increase conductivity, improve current and electroplating distribution and increase electroplating rates. Any stable, soluble salt may be used. A particularly convenient salt is ammonium chloride in the concentration range from 0.01 to 5.0 molar (or saturation) with 1.0±0.5 molar preferred.

A buffer agent is also useful for controlling the pH of the bath and incidentally increasing the conductivity of the solution. A buffer consistent with the desired pH of the solution may be used. A typical buffer for the pH values of interest here is the phosphate system, namely $K_2HPO_4$. Typical concentrations are from 0.01 to 2.0 molar with 0.5±0.2 preferred. The pH is usually adjusted by the addition of acid (e.g. HCl) or base (e.g. aqueous $NH_4$).

Several examples are set forth to illustrate the invention.

EXAMPLE 1

An aqueous electroplating bath is made up using 0.0005 molar $Pd(NH_3)_4Cl_2$, 0.01 molar $NH_4Cl$ and 0.01 molar $K_2HPO_4$. Included in the solution are a surfactant (dodecyltrimethyl ammonium chloride) and a brightener (allylphenyl sulfone) in concentrations of 0.0002 molar and 0.00005 molar respectively. The bath has a conductivity greater than $10^{-3}$ mho-cm. Excellent results are obtained on electroplating on a conductive surface (e.g. metallic surfaces such as copper, nickel, palladium, etc.).

EXAMPLE 2

Excellent results are also obtained with surfactant concentrations of 0.004M, 0.01M, 0.02M, 0.4M and saturation.

EXAMPLE 3

Excellent results are also obtained with brightener concentrations of 0.005M, 0.01M, 0.03M; 0.05M, 0.2M and saturation.

EXAMPLE 4

Excellent results are obtained with surfactants selected from aliphatic, straight-chain trimethylammonium chlorides with chain lengths from 8 to 18 carbon atoms.

EXAMPLE 5

Excellent results are obtained with a variety of brightener compounds including o-benzaldehydesulfonic acid, 1-naphthalenesulfonic acid, 2-naphthalenesulfonic acid, benzenesulfinic acid, oxy-4,4-bis(benzene)sulfinic acid, p-toluenesulfinic acid, 3-trifluoromethylbenzenesulfinic acid, allyl phenyl sulfone, o-benzoic sulfamide, benzylsulfonyl propionamide, phenylsulfonyl acetamide, 3-(phenylsulfonyl)propionamide, benzene sulfonamide, bis(phenyl sulfonyl)methane, guanidine carbonate, sulfaguanidine and nicotinic acid.

EXAMPLE 6

Excellent results are also obtained with various concentrations of palladium sources including 0.005M, 0.1M, 0.2M, 0.3M, 1.0M and saturation.

EXAMPLE 7

Excellent results are also obtained with a variety of sources of palladium including $Pd(NH_3)_4Br_2$, $Pd(NH_3)_4I_2$, $Pd(NH_3)_4SI_4$, $Pd(NH_3)_2Cl_2$ and corresponding bromide, iodide, sulfate, etc., palladium hydroxide complexes and palladium complexed with various organic compounds such as organic amines and polyamines.

EXAMPLE 8

Excellent results are also obtained using as a source of palladium such palladium compounds as $PdCl_2$, $PdBr_2$, $PdI_2$, $PdSO_4$, $Pd(NO_3)_2$, etc.

EXAMPLE 9

Excellent results are also obtained electroplating palladium alloys with metals such as nickel, cobalt, silver and arsenic. Various compounds are used as the source of the alloying metals such as chlorides, sulfates, oxides, hydroxides, etc. Various alloy compositions are obtainable including 30 mole percent alloy metal, remainder palladium, 50 mole percent alloying metal, remainder palladium and 70 mole percent alloying metal, remainder palladium.

EXAMPLE 10

Excellent results are obtained at various bath pH values including 6.0, 6.5, 7.0, 7.5, 8.0, 8.5, 9.0, 10.0, 11.0, 12.0, 13.0, and 13.5.

We claim:

1. A process for electroplating a metallic substance on a surface, said metallic substance comprising palladium comprising the step of passing current through a cathode, an electroplating bath and an anode with cathode potential great enough to electroplate palladium, said electroplating bath having a conductivity greater than $10^{-3}$ mho-cm and comprising a source of palladium characterized in that the electroplating bath further comprises a surfactant and a brightener, said surfactant selected from the group consisting of alkyl ammonium chlorides with from 4 to 35 carbon atoms and said brightener selected from the group consisting of o-benzaldehydesulfonic acid, 1-napthalenesulfonic acid, 2-naphthalenesulfonic acid, benzenesulfinic acid, oxy-4,4-bis(benzene)sulfinic acid, p-toluene sulfinic acid, 3-trifluoromethyl benzene sulfinic acid, allyl phenyl sulfone, o-benzoic sulfamide, benzylsulfonyl propionamide, phenylsulfonyl acetamide, 3-(phenylsulfonyl)propionamide, benzene, sulfonamide, bis(phenylsulfonyl)methane, guanidine carbonate, sulfaguanidine and nicotinic acid.

2. The process of claim 1 in which the surfactant is an aliphatic, straight-chain trimethylammonium chloride with chain with chain lengths between 8 and 18 carbon atoms.

3. The process of claim 2 in which the surfactant is selected from the group consisting of undecyltrimethylammonium chloride, dodecyltrimethylammonium chloride and tridecyltrimethylammonium chloride.

4. The process of claim 3 in which the surfactant is dodecyltrimethylammonium chloride.

5. The process of claim 1 in which the concentration of surfactant ranges from 0.0002 to 0.4 molar.

6. The process of claim 1 in which the brightener is selected from the group consisting of benzenesulfinic acid, 3-trifluoromethylbenzenesulfinic acid and allyl phenyl sulfone.

7. The process of claim 6 in which the brightener is allyl phenyl sulfone.

8. The process of claim 7 in which the surfactant is dodecyltrimethyl ammonium chloride.

9. The process of claim 1 in which the source of palladium comprises a palladium compound selected from the group consisting of $PdCl_2$, $PdBr_2$, $PdI_2$, $PdSO_4$ and $Pd(NO_3)_2$.

10. The process of claim 1 in which the source of palladium is a palladium complex ion compound.

11. The process of claim 1 in which the source of palladium is a palladium complex ion compound in which the complexing agent is ammonia.

12. The process of claim 1 in which the electroplating bath has a pH between 6.0 and 13.5.

13. The process of claim 12 in which the pH is between 6.5 and 8.5.

14. The process of claim 1 in which the electroplating bath comprises a conducting salt.

15. The process of claim 14 in which the conducting salt comprises ammonium chloride.

16. The process of claim 1 in which the electroplating bath comprises a buffer.

17. The process of claim 16 in which the buffer is a phosphate buffer.

* * * * *